US008047398B2

(12) United States Patent
Dimartino et al.

(10) Patent No.: US 8,047,398 B2
(45) Date of Patent: Nov. 1, 2011

(54) SNAP OVERCAP CLOSURE FOR A CONTAINER

(75) Inventors: John Louis Dimartino, Elmsford, NY (US); Leonard R. Ekkert, Lemont, IL (US); Glenn Gruskin, Nanuet, NY (US)

(73) Assignee: Kraft Foods Global Brands LLC, Northfield, IL (US)

( * ) Notice: Subject to any disclaimer, the term of this patent is extended or adjusted under 35 U.S.C. 154(b) by 636 days.

(21) Appl. No.: 11/766,861

(22) Filed: Jun. 22, 2007

(65) Prior Publication Data

US 2008/0314916 A1 Dec. 25, 2008

(51) Int. Cl.
*B65D 53/00* (2006.01)
*B65D 43/06* (2006.01)

(52) U.S. Cl. ..... 220/783; 215/344

(58) Field of Classification Search ..... 220/783, 220/782, 781, 780, 793, 380, 797, 796, 658, 220/656, 802, 801, FOR. 107, FOR. 109, 220/FOR. 105, 378, 806, 200, DIG. 19, 659, 220/657, 254.5, 254.3, 254.1, 259.1, 256.1; 215/224, 346, 341, 316, 344, 343, 200, 45, 215/43, 345, 318, 235, 355, 225, 310, 329; D9/443; 222/556, 562, 563, 544; *B65D 53/00, B65D 43/10, 43/08, 43/06, 43/04*
See application file for complete search history.

(56) References Cited

U.S. PATENT DOCUMENTS 2,922,563 A * 1/1960 Aldington ..... 206/508
2,979,218 A 4/1961 Stover
2,985,354 A 5/1961 Aldington
3,061,131 A 10/1962 Robinson
3,069,040 A * 12/1962 Corsette ..... 215/318
3,269,588 A 8/1966 Ruekberg
3,335,774 A 8/1967 Reed
3,339,786 A * 9/1967 Biglin ..... 220/781
3,353,708 A * 11/1967 Davis ..... 206/519
3,452,896 A * 7/1969 Elliot ..... 220/781
3,480,177 A * 11/1969 Elliot ..... 206/509
3,532,244 A 10/1970 Yates, Jr.
3,568,871 A * 3/1971 Livingstone ..... 215/344
3,642,167 A 2/1972 Kinney
3,743,131 A 7/1973 Croyle et al.
3,773,207 A 11/1973 Dokoupil et al.
3,779,418 A * 12/1973 Davis ..... 220/781
3,856,171 A 12/1974 Rossi
3,880,288 A 4/1975 Hunter
3,980,195 A * 9/1976 Fillmore ..... 215/256
4,027,776 A 6/1977 Douglas
(Continued)

*Primary Examiner* — Mickey Yu
*Assistant Examiner* — Robert J Hicks
(74) *Attorney, Agent, or Firm* — Stites & Harbison PLLC; Marvin Petry; Stephen J. Weyer

(57) ABSTRACT

An overcap for a container, which container is of the type having a rim adjacent to an opening in which the rim has an exterior facing top surface, an exterior facing side surface and an exterior facing bottom surface. The overcap includes a center portion having a top surface and a skirt extending downward relative to the top surface. A wall is spaced radially inward from the skirt, defining a channel in one form of the overcap. The wall has an end portion extending downwardly from the center portion. When the overcap is disposed on the container, the end portion engages with the exterior facing top surface of the rim of the container. In one further advantageous form, the overcap skirt has a bead extending radially inward, which engages with the exterior facing side surface of the container when the overcap is disposed on the container.

14 Claims, 4 Drawing Sheets

U.S. PATENT DOCUMENTS 4,078,696 A 3/1978 Crisci
4,111,329 A 9/1978 Lampman
D265,548 S 7/1982 Brundige et al.
4,407,426 A 10/1983 McLaren et al.
4,416,383 A 11/1983 Frahm et al.
4,418,833 A * 12/1983 Landis ..... 220/792
4,438,857 A 3/1984 Bullock, III
4,449,641 A 5/1984 Jorgensen et al.
4,471,880 A 9/1984 Taylor et al.
4,474,304 A 10/1984 Jacobs
4,625,876 A 12/1986 Bullock, III
4,691,834 A 9/1987 Bullock, III
4,782,976 A 11/1988 Kenyon, 2nd.
4,819,824 A * 4/1989 Longbottom et al. ..... 220/266
4,854,472 A * 8/1989 Semersky ..... 220/783
4,872,586 A * 10/1989 Landis ..... 220/781
4,886,184 A 12/1989 Chamourian
5,067,624 A 11/1991 Thanisch
RE33,764 E 12/1991 Cochrane
5,143,219 A * 9/1992 Yates, Jr. ..... 206/508
5,284,265 A 2/1994 Crisci
5,356,026 A 10/1994 Andress et al.
5,377,860 A 1/1995 Littlejohn et al.
5,415,306 A * 5/1995 Luch et al. ..... 215/256
5,421,470 A 6/1995 Dudzik
D362,186 S 9/1995 Thanisch
D374,822 S 10/1996 Philips
5,848,717 A 12/1998 Bösl et al.
5,868,273 A 2/1999 Daenen et al.
6,003,699 A 12/1999 Laszlo et al.
6,053,348 A 4/2000 Morch
6,168,044 B1 1/2001 Zettle et al.
6,220,471 B1 4/2001 Lowry
6,260,721 B1 7/2001 Ohmi et al.
6,478,183 B1 11/2002 Bacon et al.
6,834,772 B1 * 12/2004 Thorsø ..... 220/795
6,840,398 B1 * 1/2005 Blumenschein ..... 220/782
7,063,231 B2 6/2006 Stanos et al.
2002/0175172 A1 * 11/2002 Diesterbeck ..... 220/782
2002/0175174 A1 * 11/2002 Diesterbeck ..... 220/782
2003/0010787 A1 * 1/2003 Dalton et al. ..... 220/912
2005/0103742 A1 5/2005 Pairis
2006/0138073 A1 * 6/2006 Ooka et al. ..... 215/344
2007/0023383 A1 2/2007 Perrin et al.
2007/0045315 A1 * 3/2007 Evans et al. ..... 220/254.3

* cited by examiner

SNAP OVERCAP CLOSURE FOR A CONTAINER

FIELD OF THE INVENTION

The present invention relates to a closure for a container and, in particular, a snap overcap for a container.

BACKGROUND OF THE INVENTION

Packaging for various food products such as coffee, nuts, non-dairy whipped topping, etc. comprises plastic containers, such as a container formed from polyethylene or polypropylene. These containers are initially sealed with a flexible and/or peelable foil membrane which extends over the opening and allows the user to remove it by pulling back on a tab of the flexible or peelable membrane. Typically a separate overcap in the form of a simple annular disk with a vertical skirt extending downward is attached to the container to cover the opening. The overcap has an interior facing surface which engages with an exterior facing surface of the container and, in particular, the interior facing surface of the overcap engages with the chime or rim of the container.

There exists a need in the art for an improved overcap for use with containers of the type described.

SUMMARY OF THE INVENTION

The present invention relates to an overcap for a container adapted to engage with various surfaces of a container to provide a secure and tight closure. Advantageously, the overcap has interior facing surfaces which engage with exterior facing surfaces of the container, allowing the overcap to snap onto the container and to thereby provide a tight, secure engagement of the overcap with the container. Optionally, an advantageous audible snap sound is produced as the overcap is placed securely on the container. The overcap can be used with any suitable container which may be composed of steel, aluminum or plastic.

The present invention, in one form thereof, relates to a lid, or overcap, for a container, in which the container is of the type having a rim adjacent to an opening, in which the rim has an exterior facing top surface, an exterior facing bottom surface and an exterior facing side surface. The overcap has a center portion with a top surface and a skirt extending downwardly. A wall is spaced radially inward from the skirt, defining a channel. The wall has an end portion extending downward in a direction away from the top surface so as to engage the exterior facing top surface of the rim when the overcap is disposed thereon. In one advantageous further form, a bead extends radially inward from an interior facing surface of the skirt. Optionally, the overcap produces an advantageous audible sound when the overcap engages with the exterior facing surfaces of the rim of the container. In one further form, the overcap skirt has a brim formed at the end of the skirt, opposite the center portion.

The present invention, in another form thereof, comprises an overcap for a container comprising a center portion with a top surface and a wall extending both upward and downward from the center portion. A skirt is spaced radially outward from the wall and the skirt is joined to the wall at a top shoulder portion of the skirt. The skirt extends downward relative to the top surface. A sealing element extends downward from a bottom portion of the wall. A bead extends radially inward from an interior facing surface of the skirt. Advantageously, the sealing element is adapted to engage with a complementary surface of a container.

The present invention, in another form thereof, comprises a container having a container body and an overcap. The container body has an opening with a rim. The rim has an exterior facing top surface, an exterior facing side surface and an exterior facing bottom surface. The overcap has a center portion with a top surface and a skirt extending downward relative to the top surface. The skirt has an interior facing surface which faces the exterior facing top surface of the rim of the container when disposed thereon. A wall is spaced radially inward from the skirt. The wall has an end portion extending towards the skirt. A tip of the end portion engages with the exterior facing top surface of the rim of the container body when the overcap is disposed thereon. In one advantageous form, a bead extends radially inward from the interior surface of the skirt, which bead is disposed below the exterior bottom surface of the rim of the container body when the overcap is disposed thereon.

The present invention, in yet another form thereof, relates to an overcap for a container, which overcap has a center portion with a top surface and a skirt extending downward relative to the top surface. A ring extends upward from the top surface of the overcap and is disposed radially inward from the skirt, thereby defining a shoulder around a perimeter of the overcap. The ring has an outer diameter. A brim is formed at the lower end of the skirt. The brim has an inner diameter which is greater than the outer diameter of the ring. The brim has an interior facing surface and a bottom surface. Advantageously, one overcap can stack on top of a second overcap, with the shoulder of one overcap abutting the radially interior facing surface and bottom surface of the brim of a second overcap.

BRIEF DESCRIPTION OF THE FIGURES

Further characteristics and advantages of the invention will be revealed more fully in the following detailed description, provided by way of example and without restrictive intent, with reference to the attached drawings in which.

DETAILED DESCRIPTION

Referring to the figures, like numbers represent like elements among the several views. Overcap 10 is placed on top of a container 50 which packages a product 60. The product 60 can be ground roast coffee, peanuts, non-dairy whipped topping or another food item. The container 50 may be made of plastics, such as polyethylene and polypropylene, or any other suitable material, including metal, such as aluminum or steel, and can have any shape or size appropriate to package the desired product.

Figure 1:
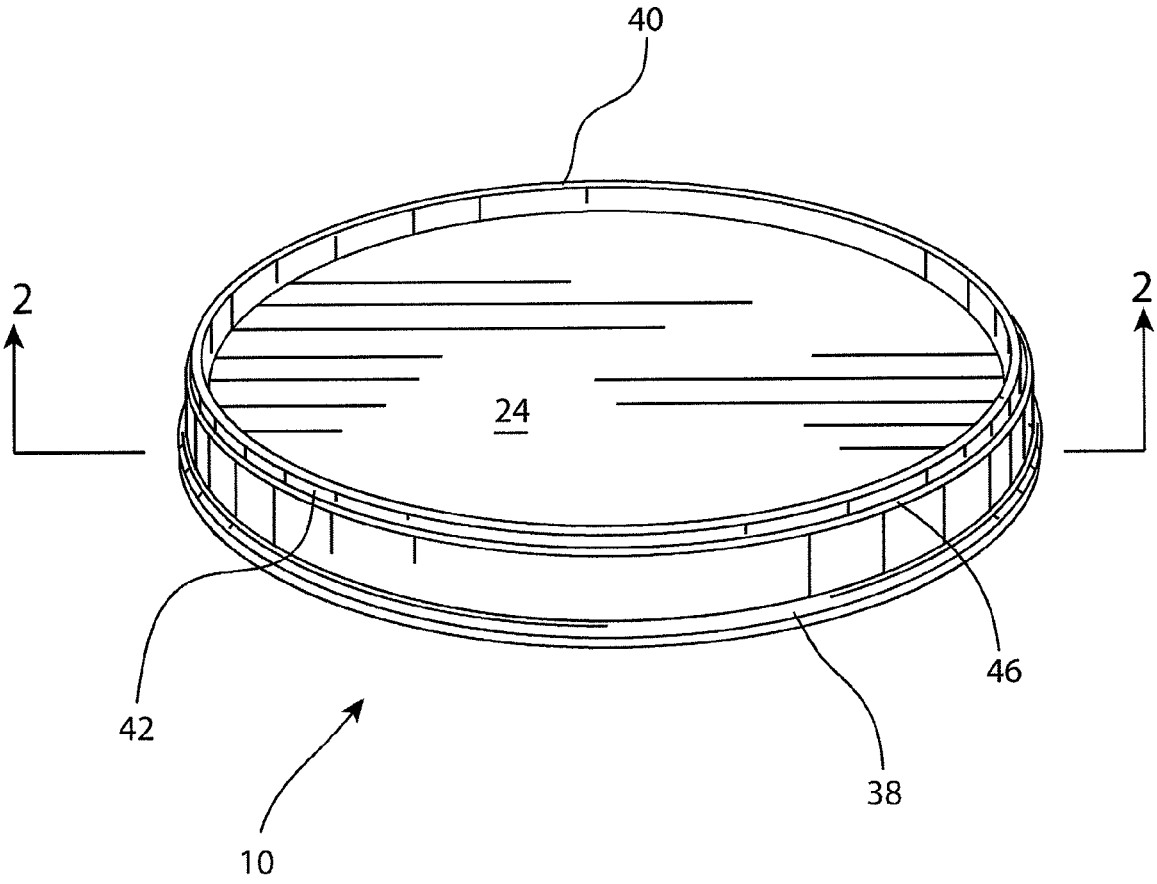
FIG. 1 is an upper perspective view of an overcap in accordance with the present invention.
Figure 2:
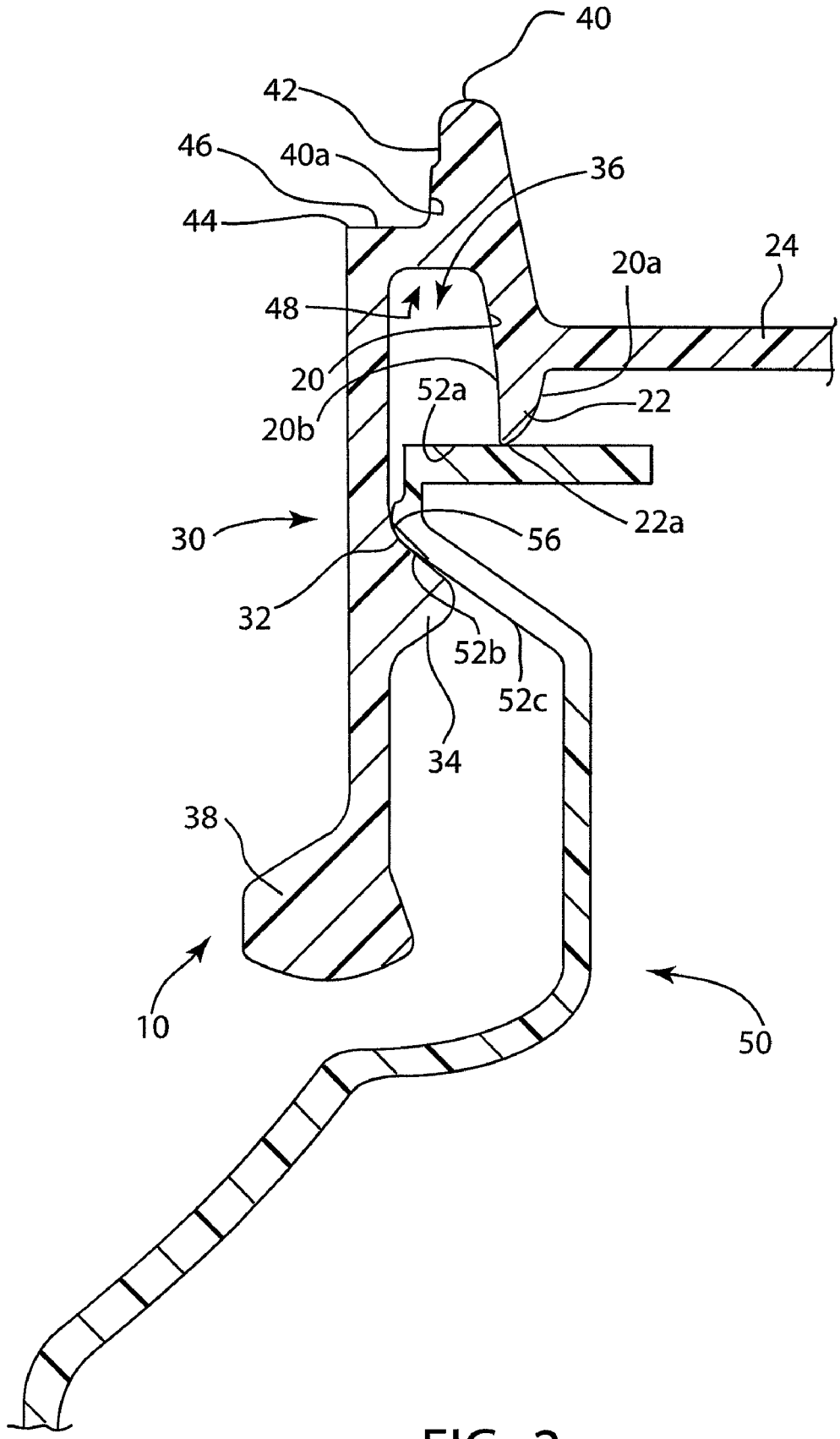
FIG. 2 is an enlarged partial cross-sectional view of the overcap, taken along line 2-2 of FIG. 1, together with the upper portion of a container on which it is mounted.
Figure 3:
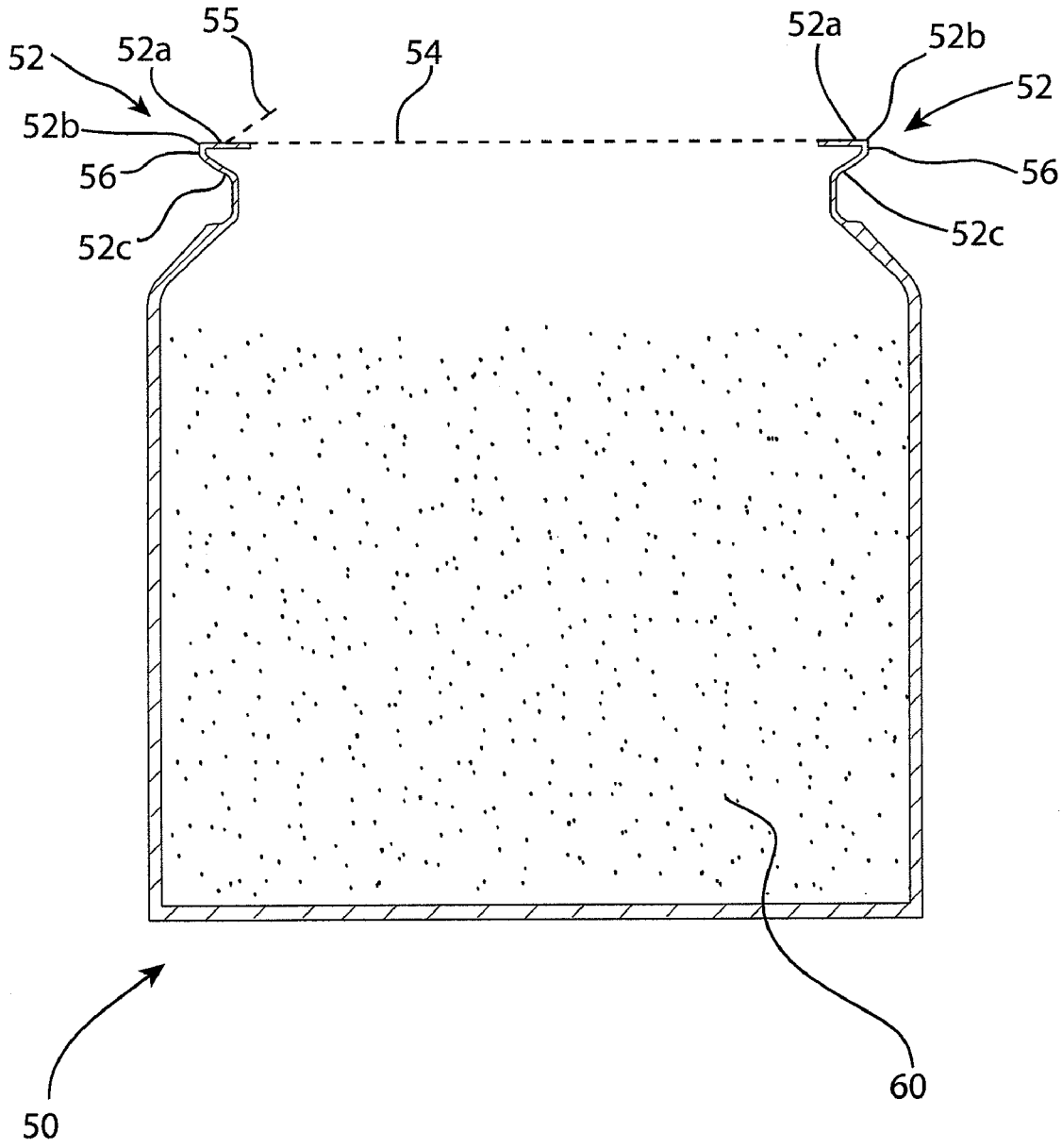
FIG. 3 is a cross-sectional view of a container with which the overcap of the present invention is used, the upper portion of which is shown in FIG. 2.

Referring specifically to FIG. 3, the top of the container 50 is sealed by a flexible peel-off membrane 54 formed of a flexible foil material, which membrane is hermetically sealed around its periphery to rim 52 at exterior facing horizontal top surface or ledge 52*a*. Rim 52, with exterior facing top surface 52*a*, exterior facing side surface 52*b* and exterior facing bottom surface 52*c*, defines a top opening of the container 50 when the peel-off membrane 54 has been removed. In a manner known per se, the easy peel-off membrane 54 has a pull tab 55.

The overcap 10 is composed of a resilient material, such as polypropylene or other suitable material. The overcap 10 comprises a center or central portion 24 which defines a top surface of the overcap 10 and a skirt 30 which extends downward relative to the top surface. The overcap 10 attaches to container 50 and is disposed over the membrane 54 prior to the container being opened for a first time. After the membrane 54 has been removed, overcap 10 seals the opening of the container 50.

The overcap 10 attaches to the container 50 at two contact or seal points of attachment. A first seal point is where outwardly concave wall or wall member 20 and, in particular, radially outward end portion 22 contacts exterior facing top rim surface 52*a* at tip 22*a*. Accordingly, tip 22*a* is a sealing element which forms a sealing surface with exterior facing top surface 52*a* of rim 52. The second contact point is where the skirt 30 contacts the rim 52. In particular, interior facing surface 32 abuts the exterior facing surface 52*b* of rim 52 at band 56, which extends slightly radially outward from the container 50. The two seal points provide a tight fit between the overcap 10 and the container 50. The tight fit advantageously keeps the contents of the container fresh.

Wall 20 and interior facing skirt surface 32 define longitudinal vertical channel 36. The wall 20 extends both upward and downward from center portion 24. The wall 20 preferably has a concave, outwardly longitudinal cross-section.

Wall 20 has an interior facing surface 20*a* and an exterior facing surface 20*b*. Advantageously, interior facing surface 20*a* is outwardly convex or outwardly curved relative to the center portion 24. In addition, advantageously, the exterior facing surface 20*b* is outwardly concave or curved.

The outwardly curved shape of the interior surface 20*a*, in conjunction with the resilient material of the overcap 10, allows the tip 22 to flex or bend in a direction towards the skirt 30 when the overcap 10 is disposed on container 50 and the tip 22 engages with the exterior facing top surface 52*a*. The wall 20 flexes outward towards the skirt 30 due to the shape of the wall 20 and, in particular, the outwardly curved interior facing surface 20*a*. In addition, the outwardly curved shape of exterior facing surface 20*b* further ensures the tip 22 will flex outward towards skirt 30. Having the wall 20 flex outward towards the skirt 30 advantageously seals the tip 22 to the exterior facing top surface 52*a* to act as a one-way valve to prevent air and, in particular, oxygen from seeping into the container 50, as well as allowing gases generated inside the container 50 to vent to the exterior, such as outgases generated from fresh ground coffee which may be disposed inside the container 50.

A brim 38 is integrally formed with and extends from the base or lower end of the skirt 30. The brim 38 helps facilitate removing the overcap 10 from the container 50 by allowing one to grasp the brim 38 with one's fingers in order to pull back and up on the overcap to lift off the overcap 10 from the container 50.

A ring 40 extends upward from a top surface of the overcap 10. A plurality of depressions or dimples 42 are formed in the radially outward surface of ring 40. The ring 40 forms a shoulder 44 around the perimeter of the overcap 10. The shoulder 44 is defined by a radially outward facing surface 40*a* and a top surface 46. The shoulder 44, along with the upper portion of the wall 20 and skirt 30, form an arch 48 which hingedly attaches the wall 20 to the skirt 30. Arch 48, which extends upward from center portion 24, provides advantageous pivot points between the wall 20 extending upward from the center portion 24 and the skirt 30. For example, arch 48 provides more flexibility or movement between wall 20 and skirt 30 than would occur were the wall 20 attached to skirt 30 at the same level or height as center portion 24.

Figure 4:
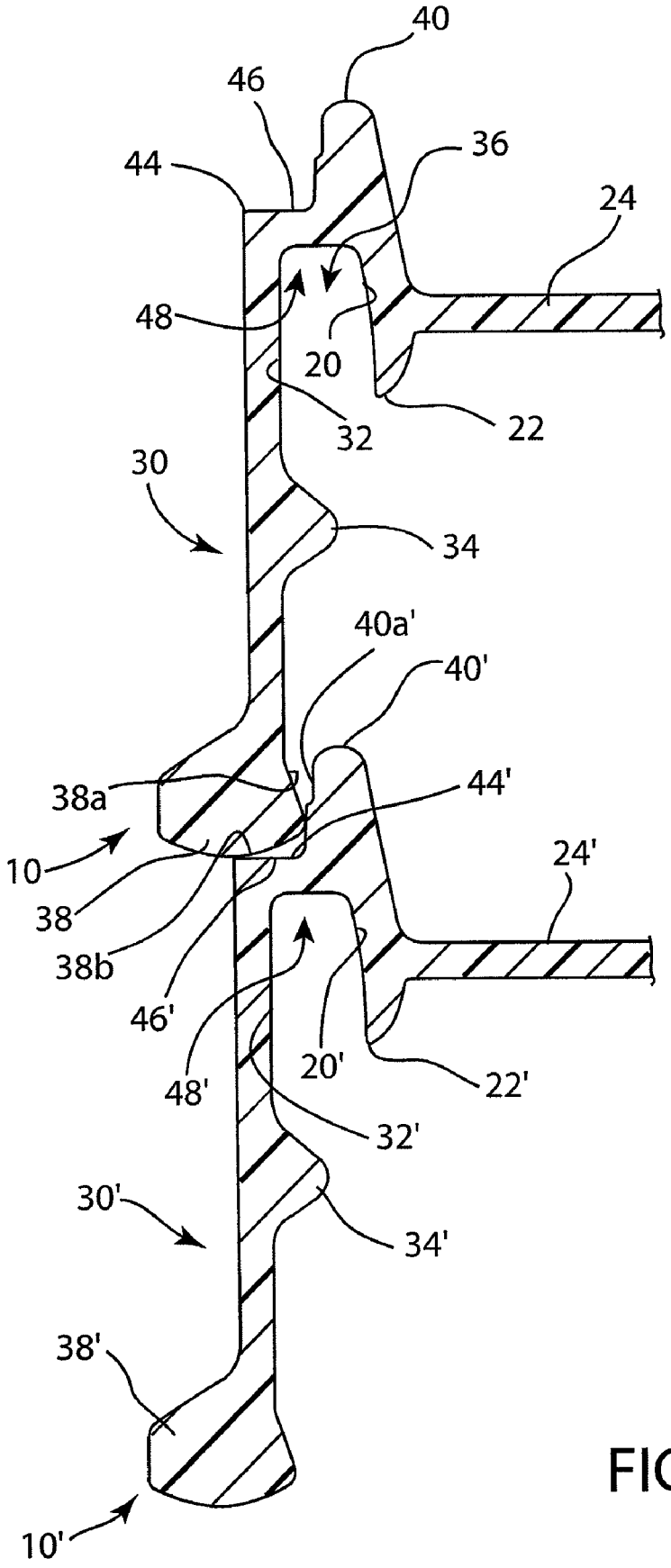
FIG. 4 is a partial cross-sectional view of two overcaps stacked on top of each other, in accordance with the present invention.

Advantageously, the outer diameter of ring 40 is less than the inner diameter of the overcap at brim 38. As shown in FIG. 4, one overcap 10 can be stacked on a second overcap 10' with the second ring 40' fitting inside the first overcap 10, with the radially outward side surface 40*a'* of ring 40' abutting the radially inward facing surface 38*a*, and the top surface 46' abutting brim bottom surface 38*b*.

After purchase of the container 50, a user first removes the overcap 10 from the container 50 and removes the membrane 54 from the opening by pulling back and up on tab 55. To seal the container 50, a user places the overcap 10 over the opening and pushes downward on the overcap 10 until the overcap 10 completely engages with the container 50.

In one optional advantageous form, an indication that the overcap 10 has fully engaged with the container 50 is provided by a snapping sound which is generated as the bead 34 passes by rim 52 prior to being positioned below the exterior facing bottom surface 52*c*. The overcap 10 is able to be snapped into place due to the combination of the composition of the material of overcap 10 and the shape and size of the skirt 30 with bead 34 and wall 20 with end portion 22.

It will now be clear to one of ordinary skill in the art that the present overcap provides features and advantages not found in prior overcaps. For example, the present overcap 10 produces a tight engagement between the overcap 10 and the container 50 when the outwardly extending end portion 22 engages with exterior facing top rim surface 52*a*, and the interior facing surface 32 of the skirt engages with the band 56. Optionally, an audible sound indicates to a consumer that the container has been sealed tightly and securely.

A second feature of one advantageous form of the present invention is that one overcap can stack on a second overcap with the ring of one overcap fitting radially interior of the skirt of a second overcap.

Although the invention has been described above in relation to preferred embodiments thereof, it will be understood by those skilled in the art that variations and modifications can be effected in these preferred embodiments without departing from the scope and spirit of the invention.

The invention claimed is:

1. A container comprising:

a container body for containing a product and having an open top, the container body having a generally horizontal annular ledge extending completely around the outer periphery of the open top, and a top edge surrounding the annular ledge, and an overcap which covers the open top and includes a skirt extending over the top edge of the container body around the circumference thereof and securely engages a side of the container body, said overcap further comprising a wall member extending downwardly and engaging the ledge completely around the open top, a bottom of the wall member flexing radially outwardly as it engages the ledge, the resiliency of the flexed wall member as it engages the ledge and its radially outward angle being such that the engagement of the bottom of the wall member and the ledge substantially prevent the ingress of air into the container while allowing gases located within the container to vent outwardly to the exterior.

2. A container according to claim 1, wherein the engagement of the skirt with the side of the container body comprises an airtight seal.

3. A container according to claim 2, wherein the airtight seal is formed by engagement of a band on an outside of the container body engaging an inwardly facing surface of the skirt.

4. A container according to claim 1, wherein the skirt comprises a circumferential bead on an inwardly facing surface thereof which snaps onto a circumferential recess on the side of the container body.

5. A container according to claim 4, wherein the bead and recess are so arranged that the snapping motion produces an audible sound.

6. A container according to claim 4, a radially outwardly facing side of the wall member being concave.

7. A container according to claim 1, a radially inwardly facing side of the wall member being convex.

8. A container according to claim 1, the overcap having a central portion, the wall member attached to the central portion and an annular ring extending upwardly from the central portion.

9. A container according to claim 8, including a generally horizontal annular shoulder extending radially outwardly from the ring, and the skirt extending downwardly from the shoulder to a level below the bottom of the wall member.

10. A container according to claim 9, wherein a portion of the bottom of the skirt is located directly beneath the shoulder, such that the bottom of the skirt will fit onto the shoulder of an identical overcap positioned beneath it, thereby permitting vertical stacking of a plurality of such overcaps.

11. A container according to claim 10, wherein the lower end of the skirt includes an enlarged brim which fits onto the shoulder of the identical overcap positioned therebeneath and engages the adjacent outer side of the ring of such overcap positioned therebeneath.

12. A container according to claim 9, wherein the ring, the skirt and the shoulder form an arch disposed above the central portion, the arch hingedly attaching the wall member to the skirt.

13. A container according to claim 8, wherein an outer diameter of the ring is less than the inner diameter of the skirt, whereby one overcap can stack on top of a second identical overcap, wherein the ring of one overcap will fit radially inside the skirt of a second identical overcap.

14. A container according to claim 8, wherein the ring has a plurality of depressions formed in the outer side of the ring.

* * * * *